US005141574A

United States Patent [19]

Takahashi et al.

[11] Patent Number: 5,141,574

[45] Date of Patent: Aug. 25, 1992

[54] PROCESS OF FORMING DISPERSIONS IN TITANIUM ALLOYS BY MELTING AND PRECIPITATION

[75] Inventors: Wataru Takahashi, Nishinomiya; Yoshihito Sugimoto, Takarazuka; Mutsuo Nakanishi, Kobe; Yoshiaki Shida, Ikoma; Minoru Okada, Nara, all of Japan

[73] Assignee: Sumitomo Metal Industries, Ltd., Osaka, Japan

[21] Appl. No.: 739,442

[22] Filed: Aug. 2, 1991

Related U.S. Application Data

[62] Division of Ser. No. 433,963, Nov. 9, 1989, Pat. No. 5,068,003.

[30] Foreign Application Priority Data

Nov. 10, 1988 [JP] Japan ..... 63-282435
Dec. 16, 1988 [JP] Japan ..... 63-318783

[51] Int. Cl.[5] ..... C22F 1/00; B22D 25/00

[52] U.S. Cl. ..... 148/206; 148/237; 148/242; 148/669; 420/417; 420/421

[58] Field of Search ..... 420/417, 421; 148/421, 148/206

[56] References Cited

U.S. PATENT DOCUMENTS

| | | | |
|---|---|---|---|
| 2,687,350 | 8/1954 | Craighead | 420/421 |
| 3,971,656 | 7/1976 | Rudy | 420/417 |
| 4,582,679 | 4/1986 | Wilson et al. | 148/421 |
| 4,639,281 | 1/1987 | Sastry | 148/417 |
| 4,902,359 | 2/1990 | Takeuchi et al. | 148/421 |
| 4,951,735 | 8/1990 | Berczik | 420/421 |

*Primary Examiner*—Upendra Roy
*Attorney, Agent, or Firm*—Burns, Doane, Swecker & Mathis

[57] ABSTRACT

A wear-resistant titanium alloy containing titanium carbides which are crystallized and/or precipitated and are dispersed in the $\beta$-phase matrix is disclosed. The alloy may further comprise $\alpha$-phase and/or additional hard particles dispersed in the $\beta$-phase matrix.

29 Claims, 2 Drawing Sheets

PROCESS OF FORMING DISPERSIONS IN TITANIUM ALLOYS BY MELTING AND PRECIPITATION

This application is a divisional, of application Ser. No. 07/433,963, filed Nov. 9, 1989 now U.S. Pat. No. 5,068,003.

BACKGROUND OF THE INVENTION

This invention relates to a wear-resistant titanium alloy and articles made thereof. In particular, it relates to a titanium alloy for use in articles such as automobile valve parts (such as engine valves, springs, and retainers), and steam turbine blades which exhibit improved resistance to sliding abrasive wear and erosion when subject to collision with high speed droplets. The alloy is light in weight, is easily deformable by hot rolling, and is weldable to other articles made of titanium or titanium alloys.

Recently, production techniques for titanium alloys have improved to the point that they are now manufactured on an industrial scale. As a result, titanium alloys are being applied to an increasing variety of articles, which take advantage of the high specific strength, good corrosion resistance, and good thermal resistance of these alloys. On the other hand, titanium alloys are also known to have low resistance to wear in a dry state, so it is quite difficult to use titanium alloys for portions of mechanical parts which are subject to sliding contact with other parts. Therefore, it is necessary to apply a wear-resistant treatment to articles such as automobile parts (e.g. engine valves) which must have good resistance to wear.

One commercially-available wear-resistant material is "Stellite" (trade name), which is known for its excellent resistance to wear. Stellite has been widely used as a hard-facing or bonding material for application to surfaces of machine parts which are subjected to abrasive wear.

There have also been attempts to apply Stellite to the surface of titanium alloys so as to improve the resistance to wear. However, although it is possible to effect hard-facing and bonding of Stellite to ferrous materials, it is impossible to do so with respect to titanium alloys. It is impractical to use Stellite so far as titanium alloys are concerned.

Therefore, "nitriding", "plating with metals such as Ni and Cr", "vapor deposition (i.e., PVD, and CVD)", or "carburizing" have been employed to form a wear-resistant film on the surface of machine parts made from titanium alloys.

A type of hardening treatment by hard-facing has been proposed so as to improve the wear resistance of titanium alloy articles. Japanese Published Unexamined Patent Application No. 61-231151 discloses a method in which hardening materials such as metal oxide (e.g., $TiO_2$), metal carbide, metal nitride or oxygen are placed onto the surface of articles made of titanium alloy, and then the hardening materials are irradiated with a high energy beam to fuse the hardening materials and form a uniform surface layer.

Japanese Published Unexamined Patent Application No. 62-56561 proposes irradiating the surface of a titanium alloy article with a high energy beam to fuse the surface, after which hardening materials such as TiN and solid-solution hardening materials such as oxygen are injected into the resulting molten pool.

However, the conventional nitriding and carburizing methods are accompanied by the formation of thermal strains, since the articles to be treated are exposed to high temperatures. It has also been pointed out that the hard coatings which are obtained by metal plating or vapor deposition are easily peeled off. Hardening by hard-facing can effect hardening of the overlays, but matching of the hardness of the hard-facing with that of the mother material being treated (e.g. ferrous materials) is not satisfactory, sometimes resulting in wearing not only of the overlays but also of the mother material. In addition, there are many cracks in the hard-facing layer and segregation of hardening materials is inevitable.

On the other hand, in wet corrosive conditions the wear resistance of titanium alloys is not as critical as in dry corrosive conditions under mild conditions. However, in the case of steam turbine blades, titanium alloys cannot exhibit a satisfactory level of resistance because of severe erosion caused by high speed droplets. For this purpose $\beta$-type titanium alloys such as Ti-15Mo-5Zr alloys and Ti-15Mo-5Zr-3Al alloys are used after aging as an erosion-shielding material for steam turbine blades made of a Ti-6Al-4V alloy. Aged $\beta$-type titanium alloys are relatively hard compared with the other titanium alloys.

However, such aged $\beta$-type titanium alloys do not have the same level of resistance against the droplet erosion as Stellite, which is successfully applied to turbine blades made of ferrous materials.

SUMMARY OF THE INVENTION

One of the objects of this invention is to provide a titanium alloy which has good resistance to abrasion not only in dry conditions but also in wet conditions without any specific surface treatment.

Another object of this invention is to provide a titanium alloy for use in hard-facing which has good resistance to abrasion in both dry and wet conditions.

Still another object of this invention is to provide machine parts which exhibit good resistance to abrasion in dry and wet conditions.

A further object of this invention is to provide hard-facing materials which are overlayed on the surface of machine parts to make the surface highly resistant to sliding abrasion.

Yet another object of this invention is to provide automobile parts such as engine valves which are provided with an overlay and which can exhibit good resistance to abrasive wear.

The inventors of this invention have made the following discoveries:

(1) There are three types for titanium alloys which are characterized by having a single $\alpha$-phase, an $(\alpha+\beta)$-phase, or a single $\beta$-phase, respectively, at room temperature. Of these, the aged $\beta$-phase titanium alloy is much superior to the other types of titanium alloys in respect to its resistance to sliding abrasion as well as erosion.

(2) However, the degree of abrasion resistance of a $\beta$-phase titanium alloy is still low compared with that of Stellite, and is inadequate for such alloys to be used as a wear-resistant material for machine parts. However, when hard particles of TiC are uniformly dispersed or crystallized or precipitated in the $\beta$-phase matrix, the resistance of the alloy to sliding abrasion as well as erosion can be markedly improved to substantially the same level as for Stellite.

(3) A titanium alloy in which hard particles of TiC are uniformly crystallized or precipitated and dispersed can be easily produced by incorporating 0.2% or more of carbon into a composition for manufacturing a β-phase titanium alloy, melting the composition, and then solidifying it. In contrast, conventional titanium alloys contain only about 0.01% of carbon.

(4) When the upper limit of carbon to be added is restricted to 5.0% by weight, the resulting titanium alloys have good hot workability (hot rolling), toughness, and ductility.

(5) When such titanium alloys are aged at 350°-550° C., fine titanium particles of α-phase are dispersed in the β-phase, resulting in age hardening with further improvement in wear resistance.

(6) Furthermore, if hard ceramic particles such as $Al_2O_3$, $TiO_2$, SiC and TiN, which do not contain a β-phase forming metallic element, preferably with an average particle diameter of 150 μm or less, are incorporated into a melt of the alloy or are dispersed in the melt, a titanium alloy having titanium carbide particles as well as hard ceramic particles dispersed throughout the β-phase matrix can be obtained, resulting in much improvement in the abrasion resistance.

(7) When an aging treatment is applied at 350°-550° C. to the titanium alloy obtained in the manner described in paragraph (6). fine α-phase titanium particles are precipitated in the β-phase, resulting in age hardening with further improvement in the abrasion resistance.

(8) The resulting titanium alloy has a low density and it is easily weldable to other titanium alloys. Therefore, the titanium alloy of this invention can successfully be employed to protect the surface of an article against abrasive wear merely by bonding the alloy to the surface of an article.

Therefore, this invention resides in a wear-resistant titanium alloy containing titanium carbides which are crystallized and/or precipitated and dispersed in a β-phase matrix.

In another form of the invention, hard ceramic particles may be dispersed uniformly throughout the matrix.

In order to further strength the β-phase matrix, the alloy may be heat treated so as to precipitate a fine α-phase.

The term "β-phase matrix" means a matrix which contains β-phase stabilizing elements such as Cr, Mo, W, Nb, Ta, V, Fe, and Mn and which retains a body-centered cubic structure, i.e., β-phase at room temperature. Commercially available titanium alloys having a single β-phase include Ti-3Al-8V-6Cr-4Mo-4Zr, Ti-15V-3Al-3Sn-3Cr, Ti-10V-2Fe-3-Al, and the like. A preferred additive is W and Cr, which are stabilizing elements of the eutectoid type. Therefore, it is preferred that W in an amount of 25% by weight or Cr in an amount of 10% by weight be added to an (α+β) titanium alloy such as Ti-6Al-4V alloy so as to further strengthen the β-phase. A large amount of W or Cr may be added to α-type metals or alloys such as pure titanium so as to form the β-phase matrix. Thus, the term "β-phase-matrix" used in this specification involves a β-phase matrix which contains a small amount of α-phase which remains after the addition of such β-phase-forming metallic elements.

DETAILED DESCRIPTION OF THE PREFERRED EMBODIMENTS

Figure 1A:
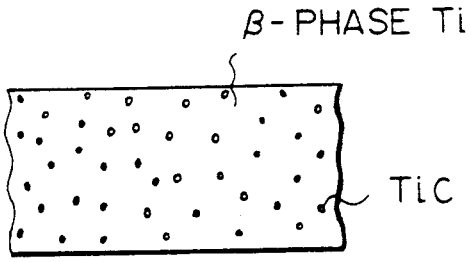
FIG. 1(*a*)-FIG. 1(*d*) are schematic illustrations of the structure of the titanium alloy of the present invention.
Figure 1B:
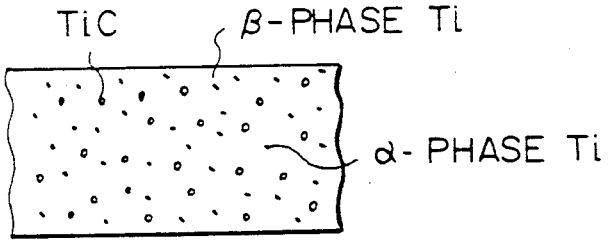
Figure 1C:
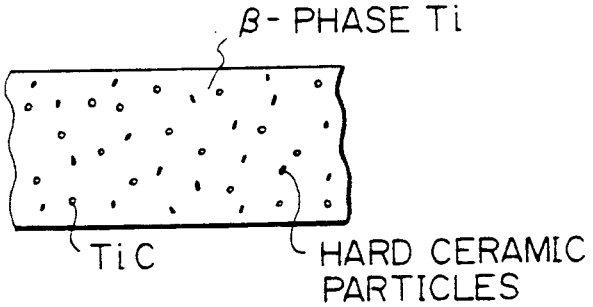
Figure 1D:
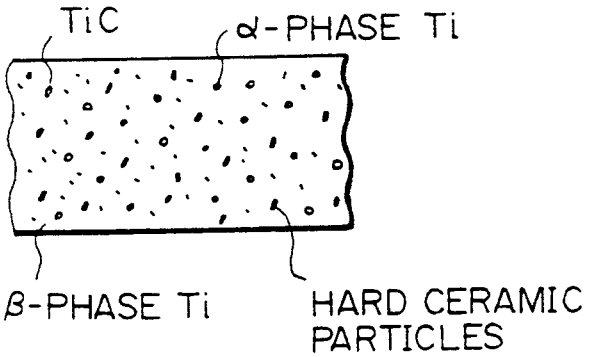

A titanium alloy of this invention comprises hard particles having an Hv hardness of 1000 or higher such as titanium carbides which are uniformly crystallized and/or precipitated and dispersed throughout the β-phase matrix. The resulting alloy exhibits excellent wear resistance, including abrasion resistance and erosion resistance.

The alloy may also comprise additional hard particles such as hard ceramic particles, which are finely dispersed in the β-phase matrix. Alternatively, the titanium alloy may further comprise fine α-phase particles which are precipitated and dispersed uniformly after being age-hardened.

In order to obtain a titanium alloy in which hard particles of titanium carbide are uniformly dispersed in the β-phase matrix, a mixture of starting materials comprising a carbide (powder) containing a β-phase forming metallic element such as $W_2C$, and $Cr_3C_2$ is melted and solidified with the carbon content of the alloy being 0.2-5% by weight. It is also possible to effect hard-facing or melt-spraying of a powder mixture of a titanium alloy and β-phase formers which form hard particles of titanium carbides upon being melted and solidified on the surface of a titanium alloy article. The resulting overlays on the titanium alloy substrate comprise titanium carbide particles uniformly dispersed in the β-phase matrix.

When β-phase formers such as W and Cr are added to a melt in the form of $W_2C$ and $Cr_3C_2$, titanium carbide (TiC) is crystallized from the melt or precipitated from the β-phase matrix in accordance with the following reactions:

$$Ti + W_2C \rightarrow TiC(\text{crystallized}) + 2W(\text{dissolved in the matrix})$$

$$Ti + \tfrac{1}{2}Cr_3C_2 \rightarrow TiC(\text{crystallized}) + 3/2Cr(\text{dissolved in the matrix})$$

The β-phase formers which are dissolved in the matrix will further strengthen the β-phase matrix.

The upper limit of the carbon content is restricted to 5% by weight, because the addition of an excess amount of carbon would result in cracking during solidification of the alloy as well as marked degradation in hot workability, ductility and toughness.

It is desirable that carbon be added in the form of a carbide, which is more easily decomposed than TiC or a bulk of carbon. Such unstable carbides are, for example, $W_2C$, and $Cr_3C_2$, and $Mo_2C$. In addition, when the β-phase-forming metallic element is added in a form of carbide powder, it is easy to precisely control the amount of the β-formers as well as the amount of the crystallized and/or precipitated carbides which are uniformly dispersed throughout the matrix. Furthermore, sometimes there is a small amount of a carbide of the $\beta$-phase-forming metallic elements remains undissolved in the matrix, but such a carbide does not have any substantially adverse effect on the wear resistance of the alloy.

FIG. 1 (*a*) shows a sketch of the microstructure of a titanium alloy of this invention, in which titanium carbide particles are crystallized and/or precipitated and dispersed uniformly in the titanium $\beta$-phase matrix. The crystallized and/or precipitated titanium carbide particles are usually ellipsoidal, spherical, or mesh-shaped. The diameter of the titanium carbide particles is preferably in the range of 0.5–25 $\mu$m so that uniformity in structure and properties can be retained throughout the alloy.

In order to obtain a titanium alloy in which titanium carbide particles as well as $\alpha$-phase particles are uniformly dispersed, it is desirable that a titanium alloy in which titanium carbide particles are uniformly dispersed be subjected to aging by heating at 350°–550° C. During aging, fine $\alpha$-phase titanium particles are precipitated in the titanium matrix containing titanium carbide particles, resulting in age hardening with improvement in wear resistance. When the aging temperature is lower than 350° C., it takes a long time to effect age hardening and sometimes the aging does not occur. On the other hand, if the temperature is higher than 550° C., overaging results and sometimes the intended increase in hardness cannot be achieved.

FIG. 1(*b*) shows the microstructure of a titanium alloy obtained by heating the alloy shown in FIG. 1(*a*) at 350°–550° C. Very fine $\alpha$-phase particles (about 0.1 $\mu$m in diameter) are uniformly precipitated and dispersed throughout the matrix in which titanium carbide particles have been dispersed.

In order to obtain a titanium alloy in which not only titanium carbide particles but also additional hard particles such as hard ceramic particles are dispersed in the $\beta$-phase matrix, a $\beta$-phase titanium alloy material containing 0.2–5% by weight of carbon is melted at a temperature lower than the melting point of the hard ceramic particles, then the hard ceramic particles are added to the melt of the alloy, and thereafter the melt is solidified. The addition of these hard particles to the melt may be carried out when all of the starting $\beta$-phase titanium alloy is melted down or when at least the surface thereof is melted. The hard ceramic particles include particles of ZrN, TiN, HfN, NbC, SiC, $Al_4C_3$, $TiB_2$, $TiO_2$ or $Al_2O_3$ which preferably have an average diameter of 150 $\mu$m or smaller. When the diameter is larger than 150 $\mu$m, if an article made thereof is a sliding member, such large hard particles will be removed from the surface during use, sometimes resulting in much degradation in the wear resistance of the article.

FIG. 1(*c*) shows the microstructure of a titanium alloy of another embodiment of this invention. The alloy is similar to the titanium alloy shown in FIG. 1(*a*) but further comprises hard ceramic particles measuring 150 $\mu$m or smaller in diameter which are finely dispersed in the matrix. In this embodiment titanium carbide particles as well as hard ceramic particles are uniformly dispersed throughout the $\beta$-phase titanium matrix.

In order to obtain a titanium alloy in which titanium carbide particles as well as additional hard particles such as hard ceramic particles and $\alpha$-phase are uniformly dispersed throughout the $\beta$-phase titanium matrix, a $\beta$-phase titanium alloy having titanium carbide particles as well as hard ceramic particles dispersed therein is subjected to aging at a temperature of 350°–550° C.

FIG. 1(*d*) shows the microstructure of a titanium alloy of still another embodiment of this invention. This alloy is obtained by heating the titanium alloy shown in FIG. 1(*c*) at 350°–550° C. In this embodiment extremely fine $\alpha$-phase (about 0.1 $\mu$m in diameter) is precipitated and dispersed uniformly throughout the $\beta$-phase matrix, in which titanium carbide has been crystallized and/or precipitated and hard ceramic particles have been dispersed.

Thus, the titanium alloy according to this invention can exhibit resistance to wear which is comparable to or much greater than that of Stellite in both wet and dry environments due to the synergistic effects of the presence of dispersed hard particles of TiC and the presence of $\beta$-phase matrix. The resistance will be further improved by the incorporation of additional hard particles such as hard ceramic particles and/or the precipitation of $\alpha$-phase. Furthermore, since the alloy is a titanium alloy, it is easy to perform welding such as TIG welding without any weld defects or something which is not possible with Stellite. In addition, when the titanium alloy of this invention is in the form of wrought metal, it can be heated to about 1000° C. to carry out hot rolling. The density of the titanium alloy of this invention can be lowered to 5 g/cm$^3$ or smaller by adjusting the addition of alloying elements without any degradation in light weight properties.

As is apparent from the foregoing, the titanium alloy of this invention is highly resistant to sliding abrasion, and it is suitable for use in manufacturing various machine parts such as automobile parts. In particular, the alloy of this invention is suitable as a hard-facing material to be overlayed on valve faces, and shaft ends of engine valves for automobile internal combustion engines.

When the titanium alloy of this invention is used for hard-facing, powders of pure titanium, $\alpha$-phase titanium alloy, $(\alpha+\beta)$-phase titanium alloy, and $\beta$-phase titanium alloy to be used as a hard-facing material are preferably in the form of polygonal particles in the range of 60–250 mesh. To this base powder, $\beta$-phase formers such as tungsten and chromium in the form of a carbide may be added to prepare a powder mixture to be used as a hard-facing material.

Hard-facing can be carried out using either a conventional PTA process in which the hard-facing material is used in the form of a powder or MIG or TIG welding in which a cored wire is used as a hard-facing material. The cored wire is formed by packing the above-mentioned mixed powders in a sheath of titanium or titanium alloy. The alloy of this invention may be used as a filler.

After finishing hard-facing, aging treatment may be performed to further precipitate the $\alpha$-phase.

In general, the above hard-facing may be applied to the valve face and shaft ends of engine valves. The peripheral surface of a valve shaft can be covered with a titanium nitride or carbide film by means of PVD or gas nitriding, platings such as chromium plating, an $MoS_2$ film, a Mo melt spray layer, or a titanium oxide film, since the surface contact pressure for the shaft is rather small.

The engine valve body can be manufactured from a conventional titanium alloy such as Ti-6Al-4V alloy or Ti-6Al-2Sn-4Zr-2Mo alloy. Any type of titanium alloy may be employed so long as it has a strength of about 100 kgf/mm$^2$. The valve body may be manufactured in one piece by means of hot forging, for example. The hot forged body may further be finished by machining, and the above-mentioned hard-facing may be applied to the valve face and shaft ends.

According to a preferred embodiment of this invention, powdery hard-facing materials with a particle size in the range of 60-250 mesh are used. When coarse particles larger than 60 mesh are present, unmelted portions sometimes remain during processing, resulting in a decrease in the bonding strength of the hard-facing to the base material so that it is rather difficult to prepare sound overlays. On the other hand, when fine particles less than 250 mesh are used, fluidity of the mixed powder is lowered, sometimes resulting in clogging of powder supply equipment.

The starting titanium alloy powder is preferably polygonal, since polygonal powder can be easily and uniformly dissolved and dispersed in a molten weld pool and it is easily and uniformly mixed with other powders such as powders of tungsten carbide, chromium carbide, or pure metal to form a uniform mixture of powders.

A polygonal powder can be produced successfully by a process including the steps of preparing titanium ingots→effecting hydrogenation→crushing→leaching, drying→sieving→collecting the hydrogenated titanium alloy powder→effecting dehydrogenation→crushing→sieving→collecting the resulting titanium alloy powder.

It is desirable that the oxygen content of the titanium alloy powder be restricted to 0.2-0.5% by weight, since the presence of oxygen in the powder improves dissolution of the powder into the mother material and wetting with the mother material. When the oxygen content falls within the above range the hardness of the overlays is 370-550 Hv so that plastic deformation of the shaft end of engine valves which usually occurs when the shaft end strikes against the valve seat can successfully be prevented. Therefore, when the oxygen content of the titanium alloy powder itself is below the above-defined range, $TiO_2$ may be added to the powder so as to obtain a mixture with a suitable content of oxygen. The use of $TiO_2$ as an additive is advantageous since a titanium alloy powder with a low content of oxygen is much easier to produce than one with a high oxygen content.

According to this invention, as already mentioned, $\beta$-phase formers are incorporated in the form of carbides, which decompose into carbon and a metal in the molten weld pool. The carbon combines with titanium to crystallize as TiC and the metal is dissolved in the matrix and further accelerates the formation of the $\beta$-phase. Vanadium, molybdenum and niobium have the same effect as in the above, though niobium carbide is less effective to stabilize the $\beta$-phase.

Hard particles which may be commingled with the starting powder include particles of an oxide such as $Al_2O_3$, $SiO_2$, and $TiO_2$, particles of a nitride such as TiN, ZrN, and HfN, particles of a carbide such as TiC, NbC, SiC, $Al_4C_3$, and HfC, particles of a boride such as $TiB_2$, and $ZrB_2$, and particles of an intermetallic compound such as TiNi.

Particles of a carbide containing a $\beta$-phase-forming metallic element are preferably added in an amount which is at least enough to form the $\beta$-phase matrix. Metal powder of a metal other than the $\beta$-phase formers may be added to adjust the hardness of the resulting overlays. These metals include pure metals such as Cu, Sn, Zr, and Ni.

When $W_2C$ powder is employed, it is added in an amount of 15-80% by weight to Ti-6Al-4V alloy powder. When $Cr_3C_2$ powder is used, it is added in an amount of 5-30% by weight. The particle size of these powders is preferably 60 mesh or smaller.

When the overlays are heated at 350°-550° C. $\alpha$-phase is precipitated to form $(\alpha+\beta)$ so that the compatibility thereof with the valve seat will be further improved.

Instead of a mixed powder, a cored wire may be employed. The wire comprises a sheath made of titanium or titanium alloy and a powder of carbide of $\beta$-phase formers packed inside the sheath. If necessary, hard ceramic particles or other hard particles may be packed inside the sheath.

A solid wire or sheet made of a titanium alloy in which a carbide and hard particles are crystallized and/or precipitated or dispersed in the $\beta$-phase matrix may be employed. Such a solid wire and sheet may be produced as follows.

Titanium alloy powder such as Ti-6Al-4V alloy powder and a carbide containing a $\beta$-phase forming metallic element such as $Cr_3C_2$, and $W_2C$ in powder form are commingled to form an electrode. If necessary, hard ceramic particles or other additional hard particles may be incorporated in the mixed powder. The electrode is melted by means of VAR (Vacuum Arc Remelting Process) to produce an ingot of the titanium alloy of this invention. The ingot is then heated to 1150° C. and hot rolled with a finishing temperature of 800° C. or higher to form hot rolled wire with a diameter of 5.5 mm. Cold rolling is applied to form a wire having a diameter of 1-4 mm for use in hard-facing the sliding surface of the machine parts such as engine valves. The sheet may be produced in substantially the same manner.

If the PREP process is available, a powder of the titanium alloy may be produced from the hot rolled material.

The present invention will be described in conjunction with the following working examples which are presented merely for illustrative purposes and are not restrictive in any way.

EXAMPLE 1

Alloys having the compositions shown in Table 1 were prepared by button melting and poured into an ingot measuring 20 mm thick, 50 mm wide and 100 mm long. The starting materials were sponge titanium, sponge zirconium, electrolytic tin, an Al-V mother alloy, an Al-Mo mother alloy, pure Al, $W_2C$ powder, $Cr_3C_2$ powder, NbC powder, and TiN powder.

The ingot was heated to 1050° C. and hot rolled to a thickness of 10 mm by three passes. The formation of defects such as cracking during hot rolling was determined.

Alloys Nos. 6, 7, 8, 11, 12, 14, 16, 17, and 18 were further heat treated after hot rolling to precipitate $\alpha$-phase.

The hardness (Vickers hardness) of the resulting hot-rolled plate (10 mm thick) was determined at room temperature.

A test piece for an abrasion test measuring 10 mm in diameter and 40 mm long and a test piece for an erosion test measuring 10 mm thick, 10 mm wide, and 15 mm long were cut from the hot-rolled plate. Another test piece for an X-ray diffraction test was also taken from the plate and the "phase" was determined by a diffractometer.

For comparison, Stellite which is usually used as an abrasion-resistant material was also tested.

Figure 2:
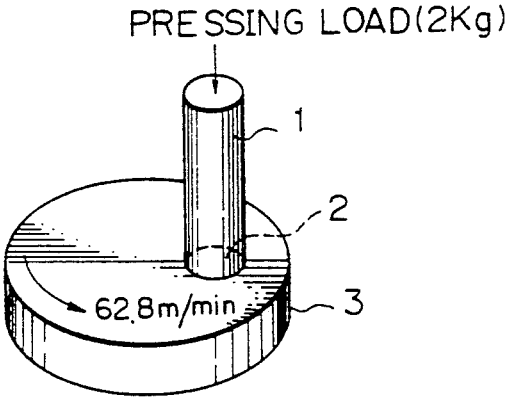
FIG. 2 is an illustration of the procedures of an abrasion test.

The abrasion test was carried out using the pin-on-disk type apparatus shown in FIG. 2 under the following conditions:

Pressing load: 2 kg
Relative sliding speed: 62.8 m/min
Sliding distance: $2.5\times10^4$ m
Objective member(disk): high tensile strength steel (60 Kg class)
Lubrication: none A test piece 1 was contacted at an end 2 with a rotating disk 3. The test piece 1 was pressed against the disk 3 at a load of 2 kg while the disk was rotating at a rate of 62.8 m/min.

The weight loss of the test piece was determined and the resistance to wear was evaluated in terms of the weight loss.

Figure 3:
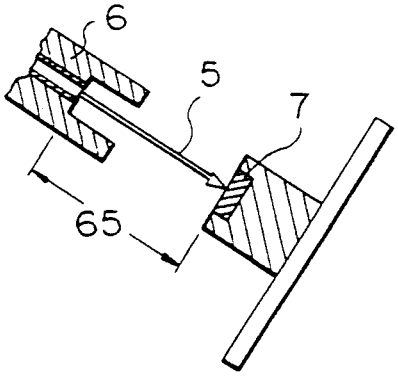
FIG. 3 is an illustration of the procedures of an erosion test.

The erosion test was carried out in the manner illustrated in FIG. 3 using a water jet 5. The jet of water was ejected through a nozzle 6 against the test piece 7 embedded in a resin under the following conditions. The surface of the test piece had previously been polished by buffing.

Nozzle Diameter for Water Jet: 1.2 mm (diameter)
Water Jet Speed: 370 m/sec.
Distance Between Nozzle And Test Piece: 65 mm
Jet Impinging Angle: 90°
Testing Time: 600 sec.

After spraying, the depth of an eroded area which was formed during spraying was measured and used to determine the resistance to erosion.

The test results are summarized in Table 1.

TABLE 1

| Alloy No. | Chemical Composition (% by weight) Al | V | Cr | Mo | Zr | Sn | W | Nb | N | C | Ti with Impurities | Edge Cracking During Hot Rolling | Heat Treatment |
|---|---|---|---|---|---|---|---|---|---|---|---|---|---|
| 1 | 6 | 4 | — | — | — | — | — | — | — | 0.5 | bal. | ○ | As Hot Rolled |
| 2 | 6 | 4 | 10 | — | — | — | — | — | — | 1.0 | bal. | ○ | As Hot Rolled |
| 3 | 6 | 4 | 10 | — | — | — | — | — | — | 1.0 | bal. | ○ | 1050° C. × 1 hr. WQ |
| 4 | 3 | 8 | 6 | 4 | 4 | — | — | — | — | 0.9 | bal. | ○ | As Hot Rolled |
| 5 | 3 | 15 | 3 | — | — | 3 | — | — | — | 0.5 | bal. | ○ | As Hot Rolled |
| 6 | 6 | 4 | 10 | — | — | — | — | — | — | 1.0 | bal. | ○ | 470° C. × 8 hr. AC |
| 7 | 3 | 8 | 6 | 4 | 4 | — | — | — | — | 0.9 | bal. | ○ | 450° C. × 20 hr. AC |
| 8 | 3 | 15 | 3 | — | — | 3 | — | — | — | 0.5 | bal. | ○ | 450° C. × 20 hr. AC |
| 9 | 3 | 8 | 6 | 4 | 4 | — | — | 9 | — | 2.0 | bal. | ○ | As Hot Rolled |
| 10 | 3 | 8 | 6 | 4 | 4 | — | — | — | 2.3 | 0.9 | bal. | ○ | As Hot Rolled |
| 11 | 6 | 4 | — | — | — | — | 2.5 | — | — | 0.5 | bal. | ○ | 450° C. × 20 hr. AC |
| 12 | 3 | 8 | 6 | 4 | 4 | — | — | — | 2.3 | 0.9 | bal. | ○ | 500° C. × 4 hr. AC |
| 13 | 6 | 4 | — | — | — | — | — | — | — | 0.01 | bal. | ○ | As Hot Rolled |
| 14 | 6 | 4 | — | — | — | — | — | — | — | 0.01 | bal. | ○ | 1000° C. × 1 hr. WQ + 500° C. × 4 hr. AC |
| 15 | 3 | 8 | 6 | 4 | 4 | — | — | — | — | 0.01 | bal. | ○ | As Hot Rolled |
| 16 | 3 | 8 | 6 | 4 | 4 | — | — | — | — | 0.01 | bal. | ○ | 450° C. × 20 hr. AC |
| 17 | 3 | 15 | 3 | — | — | 3 | — | — | — | 0.01 | bal. | ○ | 450° C. × 20 hr. AC |
| 18 | 3 | — | — | 15 | 5 | — | — | — | — | 0.01 | bal. | ○ | 450° C. × 20 hr. AC |
| 19 | Stellite No. 6 (Trade Name) | | | | | | | | | | | Δ | — |

| Alloy No. | X-ray Diffraction Analysis | Hardness (Hv) | Weight Loss (mg) | Erosion Depth (μm) | Remarks |
|---|---|---|---|---|---|
| 1 | βTi + TiC | 450 | 25 | <3 | This |
| 2 | βTi + TiC | 420 | 30 | 3 | Invention |
| 3 | βTi + TiC | 410 | 35 | 3 | |
| 4 | βTi + TiC | 410 | 35 | 3 | |
| 5 | βTi + TiC | 405 | 35 | 5 | |
| 6 | βTi + TiC + αTi | 460 | 20 | <3 | |
| 7 | βTi + TiC + αTi | 450 | 20 | <3 | |
| 8 | βTi + TiC + αTi | 440 | 25 | <3 | |
| 9 | βTi + TiC + NbC | 530 | 35 | 3 | |
| 10 | βTi + TiC + TiN | 450 | 35 | 3 | |
| 11 | βTi + TiC + αTi + $W_2C$ | 490 | 20 | 3 | |
| 12 | βTi + TiC + αTi + TiC | 620 | 30 | 15 | |
| 13 | βTi + αTi | 320 | 300 | 120 | Conventional |
| 14 | βTi + αTi | 380 | 210 | 90 | |
| 15 | βTi | 280 | 130 | 160 | |
| 16 | βTi + αTi | 440 | 80 | 45 | |
| 17 | βTi + αTi | 430 | 95 | 55 | |
| 18 | βTi + αTi | 450 | 75 | 50 | |
| 19 | — | 440 | 30 | 10 | — |

Note-[Edge Cracking]:
○ Edge Crack ≦ 3 mm.
Δ 3 mm < Edge Crack ≦ 10 mm.
× Edge Crack > 10 mm As is apparent from the results shown in Table 1, the titanium alloy in accordance with the present invention has good hot workability and a low weight loss during the sliding test. The eroded area formed during the erosion test was shallow. The resistance to wear was substantially the same as the Comparative Example (Stellite No. 6). Thus, it is apparent that the titanium alloy of the present invention has superior resistance to wear both in wet and dry circumstances.

EXAMPLE 2

Titanium alloy powders having the alloy compositions shown in Table 2 were prepared by the hydrogenated titanium crushing method. The particles of the powder were polygonal and had a particle size in the range of 80–200 mesh. The $TiO_2$, $Mo_2C$, $W_2C$ and $Cr_3C_2$ powders which were used had a particle size in the range of 100–350 mesh.

Figure 4:
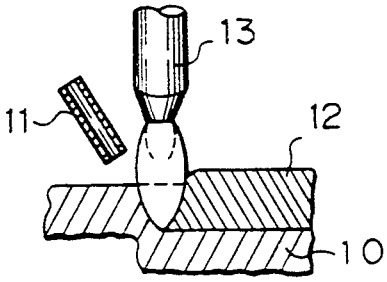
FIG. 4 is an illustration of how to carry out hard-facing of this invention.

As shown in FIG. 4, the resulting mixed powder was supplied onto the surface of the mother material 10 (100 mm diameter×40 mm height) of Ti-6Al-4V alloy through a nozzle 11 and then an overlay 12 was formed by means of the PTA process or the plasma torch process using a plasma torch 13 under the following conditions:

Travel Speed of plasma Torch: 500 mm/min
Electric Current: 150 A
Voltage: 35 V
Plasma Gas (Ar) Supply Rate: 3 l/min
Shield Gas (Ar) Supply Rate: 15 l/min
Powder Supply through Nozzle: 6 cc/min
Carrier Gas (Ar) Supply Rate: 2 l/min The hardness of the Ti-6Al-4V alloy was Hv 330.

For the purpose of comparison, hard-facing was also carried out as follows:

Run Nos. 8 to 10: The starting powder did not contain a titanium alloy powder.

Run No. 11: The starting powder was not employed but oxygen blowing was carried out.

Run No. 13: Only $TiO_2$ powder was incorporated in the starting powder so as to increase the hardness of the overlay.

Run Nos. 14 to 16: Particles other than $Cr_3C_2$, $W_2C$ and $Mo_2C$ particles were used.

The abrasion test was carried out for each case in the same manner as in Example 1.

Table 2 shows the hardness, weight loss, and surface appearance of the overlays.

TABLE 2

| Run No. | Starting Powder Composition (% by weight) | Processing | Hardened Layer Hardness (Hv) | Weight Loss (mg) | Appearance | Remarks |
|---|---|---|---|---|---|---|
| 1 | Ti-6 Al-4 V-0.3% $O_2$ + 15% $Cr_3C_2$ | PTA | 410 | 20 | Good | This |
| 2 | Ti-6 Al-4 V-0.25% $O_2$ + 40% $W_2C$ | Plasma | 460 | 15 | Good | Invention |
| 3 | Ti-6 Al-4 V-0.3% $O_2$ + 0.2% $TiO_2$ + 10% $Cr_3C_2$ + 25% $W_2C$ | Plasma | 450 | 10 | Good | |
| 4 | Ti-3 Al-8 V-6 Cr-4 Mo-4 Zr + 0.1% $O_2$ + 5% $Cr_3C_2$ | PTA | 430 | 15 | Good | |
| 5 | Ti-15 V-3 Cr-3 Sn-3 Al-0.1% $O_2$ + 10% $Cr_3C_2$ + 5% TiN | PTA | 430 | 20 | Good | |
| 6 | Ti-6 Al-4 V-0.3% $O_2$ + 50% $W_2C$ | PTA | 460 | 15 | Good | |
| 7 | Ti-6 Al-4 V-0.3% $O_2$ + 25% $Mo_2C$ | PTA | 450 | 20 | Good | |
| 8 | $Cr_3C_2$ | PTA | 1100 | — | Cracking | Conventional |
| 9 | $W_2C$ | PTA | 1050 | — | Cracking | |
| 10 | TiC | Plasma | 1100 | — | Cracking | |
| 11 | — | Plasma Oxgen Blowing | 650 | — | Cracking, Voids | |
| 12 | Ti-6 Al-4 V-0.3% $O_2$ | PTA | 390 | 190 | Severe Abrasion | Comparative |
| 13 | Ti-6 Al-4 V-1.7% $TiO_2$ | PTA | 440 | 150 | Severe Abrasion | |
| 14 | Ti-6 Al-4 V-0.3% $O_2$ + 0.2% $TiO_2$ + 15% TiC | PTA | 430 | 160 | Severe Abrasion | |
| 15 | Ti-6 Al-4 V-0.3% $O_2$ + 10% SiC | Plasma | 420 | 160 | Severe Abrasion | |
| 16 | Ti-6 Al-4 V-0.3% $O_2$ + 15% TiN | Plasma | 430 | 150 | Severe Abrasion | |

As is apparent from Table 2, according to the present invention in which $W_2C$ and $Cr_3C_2$ powders were employed, the resulting hardened overlays exhibited a sharp increase in surface hardness compared with that of the mother material of Ti-6Al-4V alloy. Weight loss was also remarkably reduced in comparison with that of comparative examples. This means that the abrasive wear resistance was highly improved in comparison with that of the comparative examples. The overlays were sound and free from cracks and voids.

In contrast, in Run Nos. 8–11, the hardened layers were unusable due to cracks and voids.

In Run Nos. 12 and 13 the surface layer had a high level of hardness and was free from voids. However, any improvement in the resistance to abrasive wear was not recognized in comparison with that of the mother material.

As shown by Run Nos. 13 to 16, the addition of hard ceramic particles is not enough to improve the abrasive wear resistance, but the addition of particles of a carbide containing a $\beta$-phase-forming metallic element such as $Mo_2C$, $W_2C$, or $Cr_3C_2$ is necessary to improve the abrasive wear resistance.

It is also noted that when the oxygen content in the titanium alloy powder was less than 0.2% and $W_2C$ powder or $Cr_3C_2$ powder was not added, the hardness of the overlays was low and the sliding surface underwent plastic deformation during testing.

EXAMPLE 3

In this example a cored wire with a diameter of 3.5 mm was used. The shell of the wire was made of pure titanium and the powder mixture used in Example 2 (Run No. 1 of Table 2) was packed therein. A test disk (100 mm in diameter×40 mm thick) of Ti-6Al-4V alloy was covered with an overlay using the cored wire by means of the plasma torch method under the same conditions as in Example 2. The resulting hardened layer had a metallurgical structure in which fine TiC particles were crystallized and/or precipitated and dispersed uniformly in the $\beta$-phase titanium matrix. A wear test was performed on the specimen in the same manner as in Example 2. Substantially the same level of abrasive wear resistance was obtained as in Run No. 1 of Table 2.

EXAMPLE 4

A Ti sponge, an Al-V mother alloy, $Cr_3C_2$ powder, and Al alloy powder were mixed to form the same alloy composition as Run No. 1 of Table 2. A VAR electrode was produced from the resulting powder mixture and the electrode was melted to form an ingot measuring 300 mm in diameter × 500 mm long and weighing 150 kgs.

The resulting ingot was heated to 1150° C., and hot forging was applied. The resulting rod (90 mm in diameter) was then subjected to hot rolling after heating to 1150° C. to form a wire having a diameter of 5.5 mm. Example 3 was repeated using this wire after cold rolling to a wire having a diameter of 3.5 mm. Substantially the same level of abrasion resistance was obtained as in Run No. 1 of Table 2.

In addition, an electrode for the PREP process was manufactured from the above-described rod having a diameter of 90 mm. Round particles measuring #60–#200 were prepared using this electrode. Then, hard-facing was carried out using this powder in the same manner as in Example 2. Substantially the same level of the abrasion resistance was obtained as in Run No. 1 of Table 2.

EXAMPLE 5

An engine valve was prepared from a hot rolled rod having a diameter of 7 mm of Ti-6Al-4V alloy by hot forging and machining. An overlay was applied to the face portion of the valve by means of PTA under the conditions shown below. The powder which was used comprised a powder of Ti-6Al-4V alloy and 40% by weight of powdered $W_2C$. Hard-facing was applied to the shaft end of the valve in the same manner except that the torch travel rate was 0 mm/min. After completing the hard-facing, finish machining was carried out on both the face surface and the shaft end. A melt spray layer of Mo was applied to the peripheral surface of the shaft of the valve.

Travel Speed of plasma Torch: 800 mm/min
Electric Current: 125 A
Voltage: 35 V
Plasma Gas (Ar) Supply Rate: 3 l/min
Shield Gas (Ar) Supply Rate: 15 l/min
Powder Supply through Nozzle: 6 cc/min
Carrier Gas (Ar) Supply Rate: 2 l/min The resulting engine valve was installed in an automobile internal combustion engine and an actual service test was conducted using this engine at 1000–5000 r.p.m. for 200 hours. After removal of the engine valve from the engine, the face, shaft surface, and shaft ends were examined visually to determine the degree of wear.

For comparison, an engine valve which was not overlayed and one which was overlayed using the powder shown in Run No. 14 of Table 2 were prepared. The two valves were then subjected to PVD treatment. They were tested in an engine in the manner described above.

The face, shaft and shaft ends of the engine valve of this invention were substantially free from wear even after 200 hours of testing. However, the face and shaft ends of the comparative valves were so severely worn after 10 hours of engine operation that the engine had to be stopped even though the valve shafts were not worn. This test showed the superior abrasion resistance of the alloy of this invention.

While the invention has been described with reference to the foregoing embodiments, various changes and modifications may be made thereto which fall within the scope of the appended claims.

What is claimed is:

1. A process for manufacturing a wear-resistant titanium based alloy comprising melting a mixture of a pure titanium and/or titanium alloy + carbide containing a $\beta$-phase-forming metallic element, then crystallizing and/or precipitating and dispersing titanium carbide.

2. A process for manufacturing a wear-resistant titanium alloy as defined in claim 1 wherein the mixture further comprises additional hard particles.

3. A process for manufacturing a wear-resistant titanium alloy as defined in claim 1, further comprising aging the resulting wear-resistant titanium alloy to precipitate and disperse $\alpha$-phase.

4. A process for manufacturing a wear-resistant titanium alloy as defined in claim 1 wherein the carbide containing a $\beta$-phase-forming metallic element is tungsten carbide and/or chromium carbide.

5. The process of claim 1, wherein titanium carbides are crystallized from a melt containing titanium or precipitated from a $\beta$-phase of the titanium based alloy.

6. The process of claim 1, wherein the carbide containing the $\beta$-phase forming metallic element comprises at least one carbide selected from the group consisting of $W_2C$, $Cr_3C_2$ and $Mo_2C$.

7. The process of claim 1, wherein the titanium based alloy contains 0.2 to 5% by weight carbon.

8. The process of claim 1, wherein the titanium carbides have diameters of 0.5 to 25 $\mu$m.

9. The process of claim 1, wherein the titanium carbides are dispersed in a $\beta$-phase matrix of the titanium based alloy.

10. The process of claim 1, wherein the titanium based alloy has a single $\beta$-phase microstructure.

11. The process of claim 1, wherein the carbide containing the $\beta$-phase forming metallic element comprises at least one carbide selected from the group consisting of $W_2C$, $Cr_3C_2$ and $Mo_2C$.

12. A process for manufacturing a wear-resistant titanium alloy as defined in claim 2, further comprising aging the resulting wear-resistant titanium alloy to precipitate and disperse $\alpha$-phase.

13. A process for manufacturing a titanium based alloy article which has a sliding surface, comprising hard-facing on the sliding surface a mixture of a pure titanium powder and/or titanium alloy powder + powder of a carbide containing a $\beta$-phase-forming metallic element, then crystallizing and/or precipitating and dispersing titanium carbide.

14. A process for manufacturing an article as defined in claim 13 wherein the mixture further comprises additional hard particles.

15. A process for manufacturing an article as defined in claim 13, further comprising aging the resulting hard-facing layer to precipitate and disperse $\alpha$-phase

16. A process for manufacturing an article as defined in claim 13 wherein the carbide containing a $\beta$-phase-forming metallic element is tungsten carbide and/or chromium carbide.

17. A process for manufacturing an articles made as defined in claim 13 wherein the pure titanium powder and/or titanium alloy powder has a particle size of 60–250 mesh and has a polygonal shape.

18. A process for manufacturing an article as defined in claim 13 wherein the article is an automobile engine valve.

19. A process for manufacturing an article as defined in claim 13 wherein the article is formed as one piece by hot forging.

20. A process for manufacturing an article as defined in claim 13 wherein hard-facing is carried out using a cored wire comprising a sheath made of pure titanium and/or titanium alloy and a packed powder containing pure titanium powder and/or titanium alloy powder together with a powder of a carbide containing a $\beta$-phase-forming metallic element.

21. A process for manufacturing an article as defined in claim 13 wherein hard-facing is carried out using a wire made of a titanium alloy which contains titanium carbide in the $\beta$-phase matrix.

22. The process of claim 13, wherein titanium carbides are crystallized from a melt containing titanium or precipitated from a $\beta$-phase of the titanium based alloy.

23. The process of claim 13, wherein the titanium based alloy contains 0.2 to 5% by weight carbon.

24. The process of claim 13, wherein the titanium carbides have diameters of 0.5 to 25 $\mu$m.

25. The process of claim 13, wherein the titanium carbides are dispersed in a $\beta$-phase matrix of the titanium based alloy.

26. The process of claim 13, wherein the titanium based alloy has a single $\beta$-phase microstructure.

27. A process for manufacturing an article as defined in claim 14, further comprising aging the resulting hard-facing layer to precipitate and disperse $\alpha$-phase.

28. A process for manufacturing an article as defined in claim 20 wherein the packed powder further contains additional hard particles.

29. A process for manufacturing an article as defined in claim 21 wherein the titanium alloy further contains additional hard particles.

* * * * *